United States Patent [19]

Grappendorf et al.

[11] Patent Number: 4,499,959

[45] Date of Patent: Feb. 19, 1985

[54] TOOTH CONFIGURATION FOR AN EARTH BORING BIT

[75] Inventors: Richard H. Grappendorf, Riverton; Jana L. Brown, Orem, both of Utah

[73] Assignee: Christensen, Inc., Salt Lake City, Utah

[21] Appl. No.: 475,168

[22] Filed: Mar. 14, 1983

[51] Int. Cl.[3] ..... E21B 10/48

[52] U.S. Cl. ..... 175/330; 175/410

[58] Field of Search ..... 175/329, 330, 410, 374, 175/375, 379; 407/118; 51/209 R, 307-309; 76/108 R, 108 A; 125/20

[56] References Cited

U.S. PATENT DOCUMENTS

| | | | |
|---|---|---|---|
| 3,692,127 | 9/1972 | Hampe et al. | 175/330 |
| 4,190,126 | 2/1980 | Kabashima | 175/330 X |
| 4,207,954 | 6/1980 | Jerome | 175/330 |

FOREIGN PATENT DOCUMENTS

| | | | |
|---|---|---|---|
| 2081347 | 2/1982 | United Kingdom | 175/329 |

OTHER PUBLICATIONS

Specialty Materials Dept. General Electric Company, "Geoset Drill Diamond", Sep. 1981.

*Primary Examiner*—Stephen J. Novosad
*Assistant Examiner*—Thuy M. Bui
*Attorney, Agent, or Firm*—Beehler, Pavitt, Siegemund, Jagger & Martella

[57] ABSTRACT

A polycrystalline diamond cutting element in a earth boring bit is affixed to the bit face by an improved tooth. The tooth includes a prepad extending from the face of the mining bit contiguous to and substantially congruous with that portion of a polycrystalline diamond element also extending from the bit face. A trailing support is provided behind the polycrystalline diamond element and is similarly contiguous and substantially congruous therewith so that a generally singular geometrically shaped body is formed by the prepad, the polycrystalline diamond element and the trailing support. The prepad and trailing support are integrally formed from the matrix material of the rotary bit and are generally arcuate about a radius centered on the bit face. The polycrystalline diamond element is thus securely retained on the bit face while exposing a maximum extent of the polycrystalline diamond element sandwiched between the prepad and trailing support.

13 Claims, 6 Drawing Figures

12
10
16
24
36
20
2
14
2
18
22

24
42
38
32
40
66
30
68
52
18
54
28
50
48
44
46

38
32
24
18
40
30
28
68
66
42
34
36

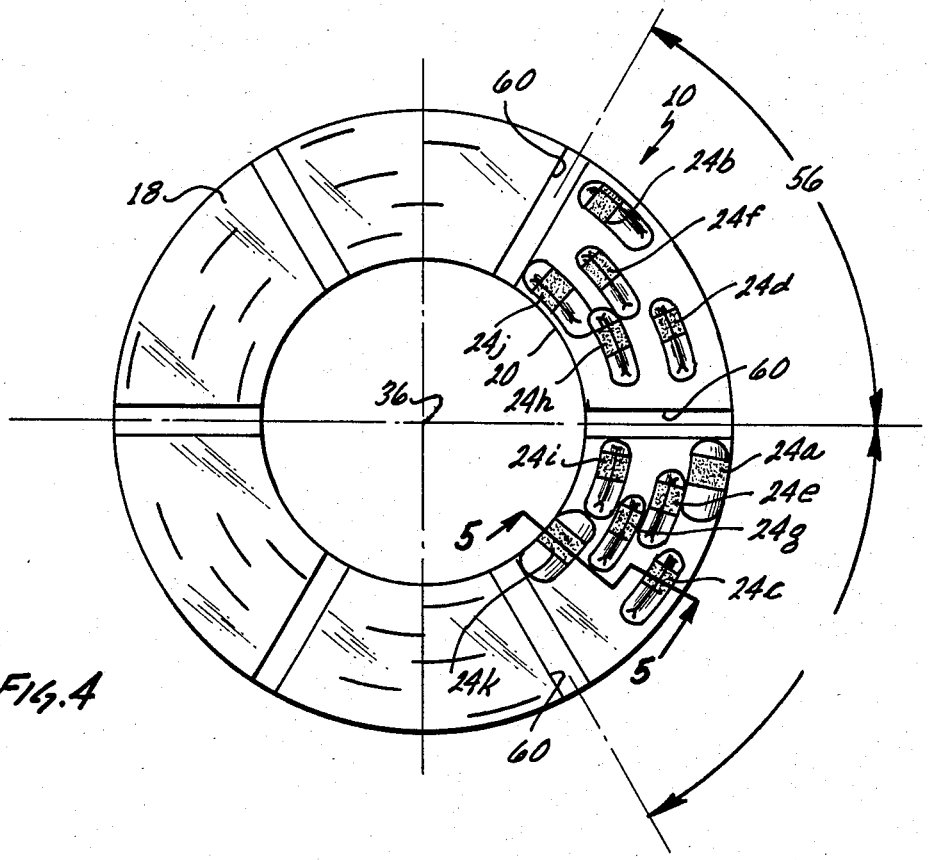
FIG. 4
FIG. 5
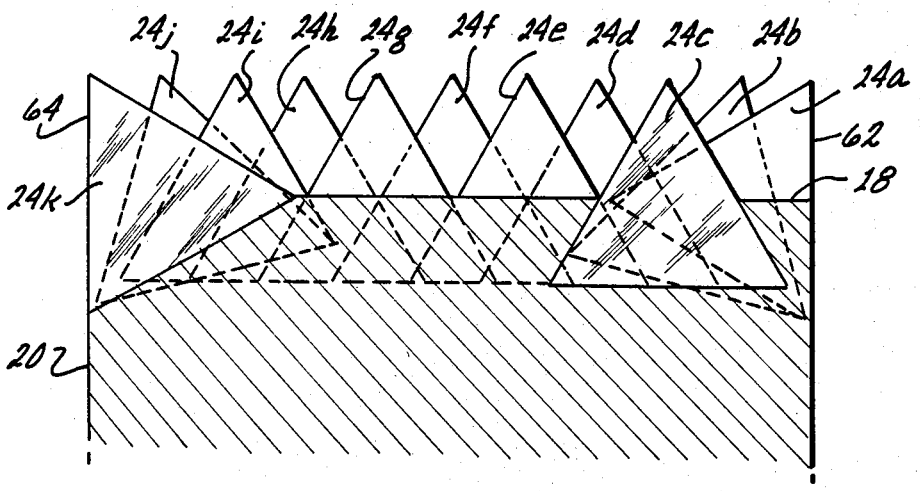

74
72
70
82
81
80
78
77
86
86
84
88
90
92
76

TOOTH CONFIGURATION FOR AN EARTH BORING BIT

FIELD OF THE INVENTION

The present invention relates to the field of earth boring bits and, more particularly, to a diamond rotary bit.

DESCRIPTION OF THE PRIOR ART

The use of diamonds in drilling products is well known. More recently synthetic diamonds both single crystal diamonds (SCD) and polycrystalline diamonds (PCD) have become commercially available from various sources and have been used in such products, with recognized advantages. For example, natural diamond bits effect drilling with a plowing action in comparison to crushing in the case of a roller cone bit, whereas synthetic diamonds tend to cut by a shearing action. In the case of rock formations, for example, it is believed that less energy is required to fail the rock in shear than in compression.

More recently, a variety of synthetic diamond products has become available commercially some of which are available as polycrystalline products. Crystalline diamonds preferentially fractures on (111), (110) and (100) planes whereas PCD tends to be isotropic and exhibits this same cleavage but on a microscale and therefore resists catastrophic large scale cleavage failure. The result is a retained sharpness which appears to resist polishing and aids in cutting. Such products are described, for example, in U.S. Pat. Nos. 3,913,280; 3,745,623; 3,816,085; 4,104,344 and 4,224,380.

In general, the PCD products are fabricated from synthetic and/or appropriately sized natural diamond crystals under heat and pressure and in the presence of a solvent/catalyst to form the polycrystalline structure. In one form of product, the polycrystalline structures includes sintering aid material distributed essentially in the interstices where adjacent crystals have not bonded together.

In another form, as described for example in U.S. Pat. Nos. 3,745,623; 3,816,085; 3,913,280; 4,104,223 and 4,224,380 the resulting diamond sintered product is porous, porosity being achieved by dissolving out the nondiamond material or at least a portion thereof, as disclosed for example, in U.S. Pat. Nos. 3,745,623; 4,104,344 and 4,224,380. For convenience, such a material may be described as a porous PCD, as referenced in U.S. Pat. No. 4,224,380.

Polycrystalline diamonds have been used in drilling products either as individual elements or as relatively thin PCD tables supported on a cemented tungsten carbide (WC) support backings. In one form, the PCD compact is supported on a cylindrical slug about 13.3 mm in diameter and about 3 mm long, with a PCD table of about 0.5 to 0.6 mm in cross section on the face of the cutter. In another version, a stud cutter, the PCD table also is supported by a cylindrical substrate of tungsten carbide of about 3 mm by 13.3 mm in diameter by 26 mm in overall length. These cylindrical PCD table faced cutters have been used in drilling products intended to be used in soft to medium-hard formations.

Individual PCD elements to various geometrical shapes have been used as substitutes for natural diamonds in certain applications on drilling products. However, certain problems arose with PCD elements used as individual pieces of a given carat size or weight.

In general, natural diamond, available in a wide variety of shapes and grades, was placed in predefined locations in a mold, and production of the tool was completed by various conventional techniques. The result is the formation of a metal carbide matrix which holds the diamond in place, this matrix sometimes being referred to as a crown, the latter attached to a steel blank by a metallurgical and mechanical bond formed during the process of forming the metal matrix. Natural diamond is sufficiently thermally stable to withstand the heating process in metal matrix formation.

In this procedure above described, the natural diamond could be either surface-set in a predetermined orientation, or impregnated, i.e., diamond is distributed throughout the matrix in grit or fine particle form.

With early PCD elements, problems arose in the production of drilling products because PCD elements especially PCD tables on carbide backing tended to be thermally unstable at the temperature used in the furnacing of the metal matrix bit crown, resulting in catastrophic failure of the PCD elements if the same procedures as were used with natural diamonds were used with them. It was believed that the catastrophic failure was due to thermal stress cracks from the expansion of residual metal or metal alloy used as the sintering aid in the formation of the PCD element.

Brazing techniques were used to fix the cylindrical PCD table faced cutter into the matrix using temperature unstable PCD products. Brazing materials and procedures were used to assure that temperatures were not reached which would cause catastrophic failure of the PCD element during the manufacture of the drilling tool. The result was that sometimes the PCD components separated from the metal matrix, thus adversely affecting performance of the drilling tool.

With the advent of thermally stable PCD elements, typically porous PCD material, it was believed that such elements could be surface-set into the metal matrix much in the same fashion as natural diamonds, thus simplifying the manufacturing process of the drill tool, and providing better performance due to the fact that PCD elements were believed to have advantages of less tendency to polish, and lack of inherently weak cleavage planes as compared to natural diamond.

Significantly, the current literature relating to porous PCD compacts suggests that the element be surface-set. The porous PCD compacts, and those said to be temperature stable up to about 1200° C. are available in a variety of shapes, e.g., cylindrical and triangular. The triangular material typically is about 0.3 carats in weight, measures 4 mm on a side and is about 2.6 mm thick. It is suggested by the prior art that the triangular porous PCD compact be surface-set on the face with a minimal point exposure, i.e., less than 0.5 mm above the adjacent metal matrix face for rock drills. Larger one per carat synthetic triangular diamonds have also become available, measuring 6 mm on a side and 3.7 mm thick, but no recommendation has been made as to the degree of exposure for such a diamond. In the case of abrasive rock, it is suggested by the prior art that the triangular element be set completely below the metal matrix. For soft nonabrasive rock, it is suggested by the prior art that the triangular element be set in a radial orientation with the base at about the level of the metal matrix. The degree of exposure recommended thus depended on the type of rock formation to be cut.

The difficulties with such placements are several. The difficulties may be understood by considering the dynamics of the drilling operation. In the usual drilling operation, be it mining, coring, or oil well drilling, a fluid such as water, air or drilling mud is pumped through the center of the tool, radially outwardly across the tool face, radially around the outer surface (gage) and then back up the bore. The drilling fluid clears the tool face of cuttings and to some extent cools the cutter face. Where there is insufficient clearance between the formation cut and the bit body, the cuttings may not be cleared from the face, especially where the formation is soft or brittle. Thus, if the clearance between the cutting surface-formation interface and the tool body face is relatively small and if no provision is made for chip clearance, there may be bit clearing problems.

Other factors to be considered are the weight on the drill bit, normally the weight of the drill string and principally the weight of the drill collar, and the effect of the fluid which tends to lift the bit off the bottom. It has been reported, for example, that the pressure beneath a diamond bit may be as much as 1000 psi greater than the pressure above the bit, resulting in a hydraulic lift, and in some cases the hydraulic lift force exceeds 50% of the applied load while drilling.

One surprising observation made in drill bits having surface-set thermally stable PCD elements is that even after sufficient exposure of the cutting face has been achieved, by running the bit in the hole and after a fraction of the surface of the metal matrix was abraded away, the rate of penetration often decreases. Examination of the bit indicates unexpected polishing of the PCD elements. Usually ROP can be increased by adding weight to the drill string or replacing the bit. Adding weight to the drill string is generally objectionable because it increases stress and wear on the drill rig. Further, tripping or replacing the bit is expensive since the economics of drilling in normal cases are expressed in cost per foot of penetration. The cost calculation takes into account the bit cost plus the rig cost including trip time and drilling time divided by the footage drilled.

Clearly, it is desirable to provide a drilling tool having thermally stable PCD elements and which can be manufactured at reasonable costs and which will perform well in terms of length of bit life and rate of penetration.

It is also desirable to provide a drilling tool having thermally stable PCD elements so located and positioned in the face of the tool as to provide cutting without a long run-in period, and one which provides a sufficient clearance between the cutting elements and the formation for effective flow of drilling fluid and for clearance of cuttings.

Run-in in PCD diamond bits is required to break off the tip or point of the triangular cutter before efficient cutting can begin. The amount of tip loss is approximately equal to the total exposure of natural diamonds. Therefore, an extremely large initial exposure is required for synthetic diamonds as compared to natural diamonds. Therefore, to accommodate expected wearing during drilling, to allow for tip removal during run-in, and to provide flow clearance necessary, substantial initial clearance is needed.

Still another advantage is the provision of a drilling tool in which thermally stable PCD elements of a defined predetermined geometry are so positioned and supported in a metal matrix as to be effectively locked into the matrix in order to provide reasonably long life of the tooling by preventing loss of PCD elements other than by normal wear.

It is also desirable to provide a drilling tool having thermally stable PCD elements so affixed in the tool that it is unable in specific formations without the necessity of significantly increased drill string weight, bit torque, or significant increases in drilling fluid flow or pressure, and which will drill at a higher ROP than conventional bits under the same drilling conditions.

BRIEF SUMMARY OF THE INVENTION

The present invention is an improvement in a rotating bit which is composed of matrix material and has a plurality of discrete cutting teeth disposed on the face of the bit. Each tooth is composed of a projection extending from the face of the bit. The tooth is particularly characterised in that it has a longitudinal axis or apical ridge substantially parallel at each point of the tooth to the direction of travel when the bit is rotated. The tooth is also characterised by having a generally triangular perpendicular cross section at each point along the longitudinal tooth axis in the plane of the bit face. The tooth includes a similarly shaped triangular polycrystalline diamond element disposed therein which has a substantially congruent cross section to the triangular cross section of the projection. The polycrystalline diamond element extends at least in part from the base of the tooth at the face of the bit to the apex of the tooth. The polycrystalline diamond element also has a leading face disposed in the tooth behind the leading edge of the tooth and in front of the midpoint of the tooth. By reason of this combination of elements, the polycrystalline diamond element is thus supported on its leading face and on its opposing trailing face by the matrix material making up the tooth, which matrix material is integral with the bit. The entire tooth including the polycrystalline element thereby forms a leading prepad, a diamond cutting element, and a substantially longer trailing support. The prepad and trailing support are disposed on each end of the polycrystalline diamond element.

BRIEF DESCRIPTION OF THE DRAWINGS

FIG. 4 is a diagrammatic plan view of the mining bit shown in FIG. 1.

FIG. 5 is a diagrammatic view taken through line 5—5 of FIG. 4 showing the placement and orientation of cutting teeth across the face of the rotary bit of FIG. 1.

The present invention and its various embodiments are better understood by viewing the above described Figures in light of the following detailed description.

DETAILED DESCRIPTION OF THE PREFERRED EMBODIMENTS

Synthetic polycrystalline diamonds are readily available at a cost highly competitive with similarly sized natural diamonds of industrial quality and have virtually the same if not better wear characteristics and generally less friability. In addition, synthetic diamonds have the particular advantage of being manufactured in uniform and regular shapes which can be exploited to maximize cutting efficiency. However, thermally stable polycrystalline diamond (PCD) elements are manufactured in such sizes that their retention on the face of a drill bit is not a trivial matter.

PCD elements currently manufactured by General Electric Company under the trademark GEOSET are triangular prisms having an equilateral triangular cross section perpendicular to the longitudinal axis of the triangular prismatic shape. The typical dimensions of such PCDs presently available are 2.6 millimeters in length and 4.0 millimeters on a side. A larger sized thermally stable GEOSET, 6.0 mm on a side and a 3.7 mm thick, are also now available.

According to the present invention, such PCD elements can be retained upon the face of a rotary bit provided that the projecting portion of each PCD is supported by integral matrix material extending from the rotary bit face to form a prepad and tail support. The prepad and tail support have a mutually congruent triangular cross section and together with the PCD element form a V-shaped tooth having a generally arcuate apical edge defining the top of the ridge of the tooth. The manner in which such tooth is formed and its configuration in a mining bit is better understood by referring to the Figures described below.

Figure 1:
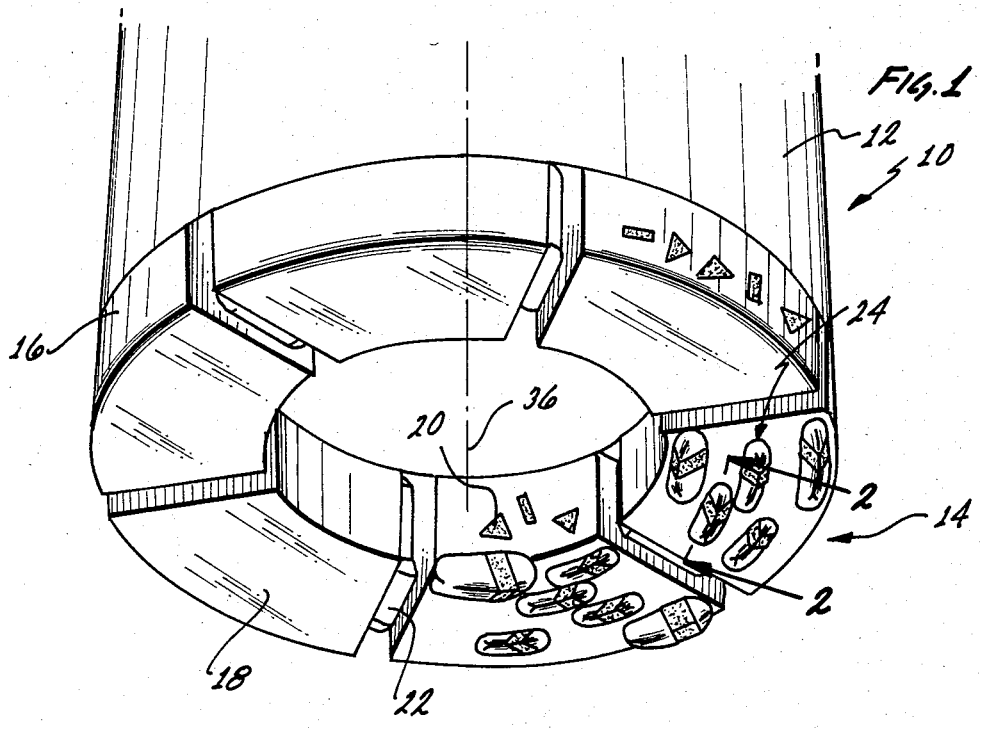
FIG. 1 is an isometric view showing the face of a mining bit having teeth devised according to the present invention.

Referring now to FIG. 1, a perspective view of a mining bit 10 is illustrated. Mining bit 10 includes a steel shank 12 provided with a conventional threading or means of engagement (not shown) to fit standardized pin and box threads used in connection with drill strings. Bit 10 also includes a bit crown generally denoted by reference character 14, having an outer gage 16, and end-face 18 and inner gage 20. The tooth construction and layout of the present invention is shown in the context of the simplified mining bit as illustrated in FIG. 1 only for the purposes of illustration and it must be understood that such a tooth can be used in many other types of bits including both mining bits and petroleum bits other than those illustrated here. Bit face 18 also includes a plurality of collectors or waterways 22 radially defined in the bit face between inner gage 20 and outer gage 16.

Figure 2:
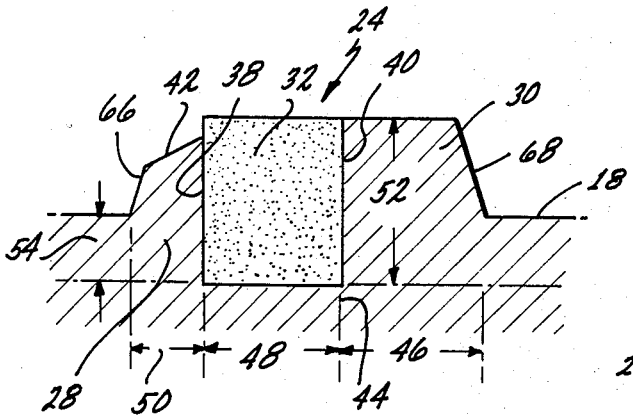
FIG. 2 is a longitudinal sectional view in enlarged scale taken through curved line 2—2 of FIG. 1.

Bit face 18 is particularly characterised by having a plurality of teeth 24 defined thereon projecting from bit face 18. In addition, inner gage 20 and outer gage 16 are provided with a plurality of PCD elements set substantially flush with the gage to provide the cutting and wearing surface for the respective gage. FIG. 2 illustrates in simplified sectional view in enlarged scale taken through line 2—2 of FIG. 1, a single tooth, generally denoted by reference character 24. Tooth 24 is particularly characterised by including a prepad portion 28 and a trailing support portion 30 on each side of PCD element 32. Prepad 28 and trailing support 30 are integrally formed with the conventional matrix material forming bit face 18 of bit 10. Typically, matrix material of bit 10 is a conventional formulation of tungsten carbide cast in a mixture with small amounts of binder alloys.

Figure 3:
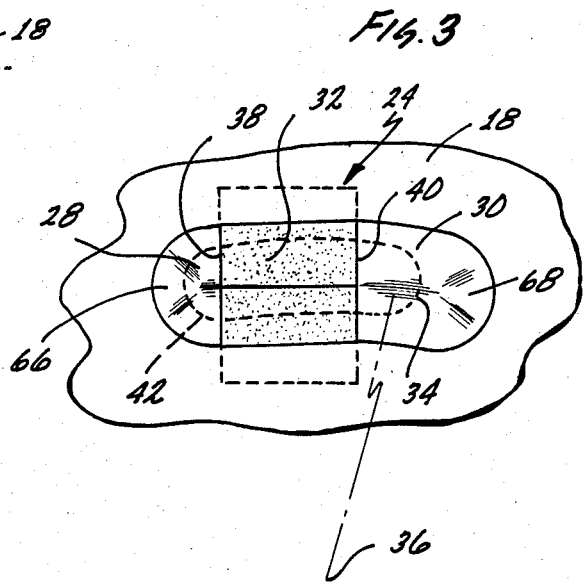
FIG. 3 is a plan view of the tooth shown in FIG. 2.

A top plan view of tooth 24 is illustrated in FIG. 3 and clearly shows an apical ridge 34 arcuately defined about longitudinal bit axis 36. Prepad 28 is adjacent and contiguous to PCD element 32 on leading face 38 of element 32. Similarly, trailing support 30 is adjacent and contiguous to trailing face 40 of element 32, thereby in combination providing full tangential support to the PCD element 32 as rotary bit 10 rotates about longitudinal bit axis 36. When rotary bit 10 rotates, the first impact of tooth 24 with the rock formation being drilled is with prepad 28. Prepad 28 thus serves to lock PCD element 32 within tooth 24. As tooth 24 wears, prepad 28 is worn away with the amount of wear limited by the much harder PCD element 32. Edge 42 in FIG. 2 shows a leading edge of prepad 28 thereby exposing just that portion of leading face 38 of element 32 which is involved at any instant of time with the actual cutting process.

Similarly, the longer trailing support 30 shown in FIGS. 2 and 3 provide a mechanical backing to prevent fracture of element 32 under drilling stresses. In the preferred embodiment, trailing face 40 of element 32 is disposed within tooth 24 at or near midpoint 44 of tooth 24 so that trailing support 30 constitutes approximately half of the total length of tooth 24. For example, referring to the preferred embodiment of FIG. 2, trailing support 30 has a lineal dimension 46 as measured on an arc centered about longitudinal axis 36 with thickness 48 of element 32 being approximately 2.6 mm (a 2102 GEOSET manufactured by General Electric Co.) and thickness 50 of prepad 28 being minimized by the setting of PCD element 32 as far forward in the mold indentation as mechanically possible. Sufficient material must be provided in trailing support 30 to provide the rigidity necessary to support trailing face 40 of element 32 to prevent fracture or loss of PCD element 32 which otherwise would occur if element 32 were unsupported.

In addition to providing support to element 32 to prevent fracture, prepad 28 and tail support 30 serve in combination as a means for securing the disposition of element 32 on bit face 18. Without the means provided by the present invention the most common source of bit failure is due to the loss or breakage of the PCD elements. Prepad 28 and 30 serve in combination to secure the disposition of element 32 within tooth 24 by providing forward and rearward contiguous mechanical engagement with element 32 in the tangential direction. For example, a PCD element 32 of triangular prismatic shape having a thickness 48 of approximately 4.0 millimeters and a height 52 of approximately 3.5 millimeters can be embedded below bit face 18 by a depth 54 of approximately 1.5 millimeters thereby exposing a maximum height of approximately 2.0 millimeters above bit face 18 for useful cutting action. For the purposes of this specification, height of said PCD element 32 is measured in a direction perpendicular to bit face 18 at the point of deposition of the tooth thereon. It has been determined that not until when approximately 2.0 mm of PCD element 32 has been worn away, is a significant probability of total element loss encountered. In this way, as soon as tooth 24 is substantially worn away, or nearly flush with bit face 18, the maximum amount of PCD element 32 has been usefully used in the cutting process before any significant probability of tooth loss is encountered. The optimal depth by which PCD 32 is embedded in bit face 18 can be empiracally determined for any size element for disposition in a tooth made according to the teachings of the present invention. However, the proportions of the preferred embodiment are illustrative. In other words PCD element 32 is embedded below bit face 18 by approximately 35–45% of its total height and is disposed within and forms part of a tooth which is at least two times longer than the azimuthal thickness of PCD element 32, which tooth includes a prepad and trailing support.

Referring now to FIG. 4, the teeth of the present invention are shown in diagrammatic plan view as configured on bit face 18 of a conventional mining bit 10. Bit face 18 is sectored into six sections of two types with each section encompassing a sixty degree sector of bit face 18. Consider first a sector 56 which is depicted as including five teeth 24*b*, 24*d*, 24*f*, 24*h* and 24*j*. A second sixty degree section 58 includes a second pattern comprised of teeth 24*a*, 24*c*, 24*e*, 24*g*, 24*i*, and 24*k*. In bit 10, each of sectors 56 and 58 are separated by radial waterways 60. The diagrammatic radial placement of teeth 24*a*–24*k* is better understood by referring now to FIG. 5 which shows in enlarged scale a diagrammatic sectional view through curve 5—5 of FIG. 4 of the overlapping radial displacement of teeth 24*a*–24*k*. Teeth 24*c*–24*i* form a series of inner teeth, each set in a substantially perpendicular manner to bit face 18 and radially spaced with respect to the adjacently disposed teeth to form in sections 56 and 58 an alternating series of cutting elements. For example, tooth 24*c* is the outermost tooth of the inner set and is disposed in section 58 and is next radially adjacent to tooth 24*d* from section 56. Similarly, tooth 24*d* in section 56 is next radially adjacent to tooth 24*e* from section 58. The series alternates between teeth selected from sections 56 and 58 until the innermost one of the inner set of teeth is reached, namely, tooth 24*i*.

Outer teeth 24*a* and 24*k* define the gage of bit 10. Tooth 24*a* is the radially outermost tooth on section 58 and tooth 24*k* also from section 58, is the radially innermost tooth of bit 10. Teeth 24*a* and 24*k* are tilted with respect to the perpendicular of bit face 18 such that their corresponding apical ridges 24*a* and 24*k* are placed outwardly as far as possible to define the gage dimension. In the preferred embodiment, the outermost surface 62 of tooth 24*a* and the innermost surface 64 of tooth 24*k* are set so as to be substantially perpendicular to bit face 18.

The radially adjacent teeth 24*b* and 24*j* from section 56 are disposed to project from bit face 18 in the next radially adjacent positions between teeth 24*a* and 24*c* in the case of tooth 24*b*, and in the case of tooth 24*j* between teeth 24*k* and 24*i*. Teeth 24*b* and 24*j* are also inclined to provide cutting coverage out to the gage of bit 10. However, instead of being tilted 30 degrees so that outer surface 62 is perpendicular to bit face 18, teeth 24*b* and 24*j* are tilted approximately 15 degrees away from perpendicular alignment to provide a smooth and more event cutting action from the outer and inner gage toward the inner set of cutting teeth 24*c*–24*i*.

Many alterations and modifications may be made by those having ordinary skill in the art without departing from the spirit and scope of the present invention. Larger dimensional triangular prismatic diamonds could be used with equal ease, such as a PCD sold by General Electric Co. under the trademark GEOSET 2103 measuring 6.0 mm on a side and 3.7 mm thick. For example, referring to FIGS. 2 and 3, the leading edge 66 of prepad 28 and the trailing edge 68 of trailing support 30 have been shown as slightly inclined with respect to the vertical and are shown in FIG. 3 as having a generally circular plan outline. It is entirely possible that with appropriate tooling, tooth 26 could be shaped with flat or abrupt and substantially perpendicular faces 66 and 68. The shape depicted in the preferred embodiment is assumed only as a matter of convenience of manufacture the molding process of tooth 26 and does not represent a critical design limitation. Furthermore, the polycrystalline diamond cutting element of the present invention has been shown as used in a mining core bit in a simplified fixture. It is of course possible that that same tooth could be employed in mining bits of more complex designs or in petroleum bits without deparing from the spirit and scope of the present invention.

Figure 6:
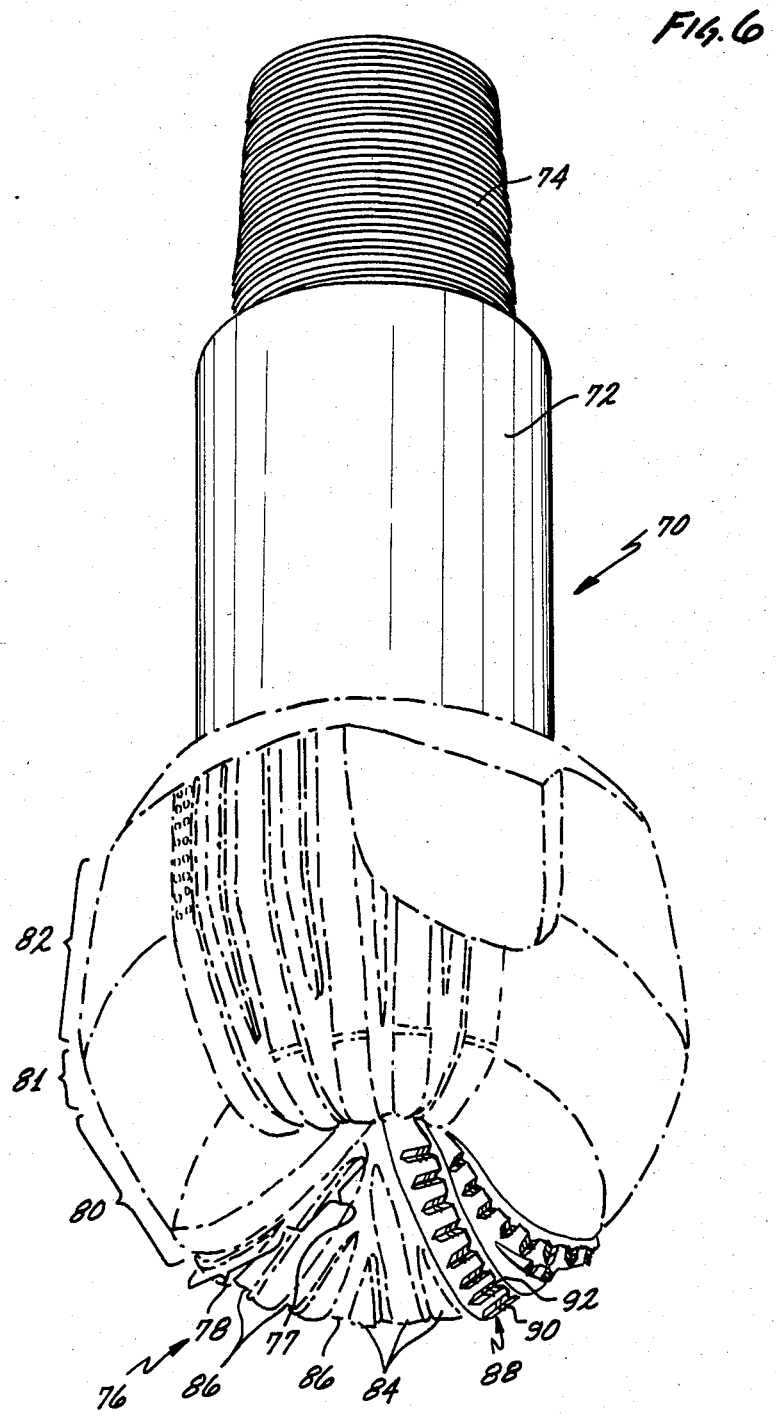
FIG. 6 is a pictorial view of a petroleum bit incorporating teeth devised according to the present invention.

FIG. 6 is a perspective view of a petroleum bit incorporating teeth improved according to the present invention. Petroleum bit 70, as in the case of mining bit 10 illustrated in connection with FIGS. 1–5, includes a steel shank 72 and conventional threading 74 defined on the end of shank 72 for coupling with a drill string. Bit 70 includes at its opposing end a bit face, generally denoted by reference numeral 76. Bit face 76 is characterised by an apex 77, a nose portion generally denoted by a reference numeral 78, a shoulder portion generally denoted by reference numeral 81, a flank portion generally denoted by reference numeral 80, and a gage portion generally denoted by reference numeral 82. Bit face 76 includes a plurality of pads 84 disposed in a generally radial pattern across apex 77, nose 78, flank 79, shoulder 80 and gage 82. Pads 84 are separated by a corresponding plurality of channels 86 which define the waterways of bit face 76. Drilling mud is provided to the waterways of bit face 76 from a central conduit (not shown) defined in a conventional manner within the longitudinal axis and body of bit 70.

As illustrated in perspective view in FIG. 6, each pad 84 includes a plurality of teeth 88 defined thereon such that the longitudinal axis of the tooth lies along the width of the pad and is oriented in a generally azimuthal direction as defined by the rotation of bit 70. PCD elements 90 included within tooth 88 with a prepad 92 contiguous with and prefacing PCD 90 which is followed by and supported by trailing support 94. Prepad 92, PCD element 90 and trailing support 94 as described above consituting a singular geometric body comprising the tooth 88. As illustrated in the FIG. 6, PCD elements 90 are disposed near the leading edge of each pad 84, prepad 92 in each case being adjacent to the leading edge of its corresponding pad 84. Thus, bit 70 as shown in FIG. 6 is designed to cut when rotated in the clockwise direction as illustrated in FIG. 6.

The particular design of petroleum bit 70 as shown in FIG. 6 has been arbitrarily chosen as an example and a tooth design improved according to the present invention can be adapted to any pattern or type of petroleum coring or other type of drilling bit according to the teachings of the present invention.

Therefore, the illustrated embodiment has been described only for the purposes of clarification and example and should not be taken as limiting the scope or application of the following claims.

We claim:

1. A rotatable bit for use in earth boring comprising:

a matrix body member having portions forming a gage and a face, said face including a plurality of waterways forming pad means between adjacent waterways, each said pad means including a plurality of spaced synthetic polycrystalline diamond cutting elements mounted directly in the matrix during matrix formation, each of said cutting elements being of a predetermined geometric shape and being temperature stable to at least about 1200° C., the said cutting elements including a portion received within the matrix body member of said pad means and a portion which extends above the surface of said pad means and which is adapted to form the cutting face of said cutting element, each cutting element including side faces and a rear face spaced from said cutting face, matrix material extending above said pad means and forming a plurality of spaced teeth, at least some of said cutting elements being positioned in said teeth, at least some of said teeth including a trailing support contacting the rear of the associated cutting element, at least some of said teeth which include a trailing support also including a prepad of matrix material extending above said pad and contacting and at least partially covering the cutting face of at least some of the associated cutting elements, the side faces of each of the cutting elements received in said teeth being fully exposed above said paid, the length of said tooth to the rear of said cutting element being greater than the length of said prepad, and the portion of each of said cutting elements which forms the cutting face of said cutting elements extending more than 0.5 mm above the surface of the corresponding pad.

2. A rotatable bit as set forth in claim 1, wherein said cutting element is a porous synthetic polycrystalline diamond.

3. A rotatable bit as set forth in claim 1, wherein said bit is a core bit.

4. A rotatable bit as set forth in claim 1, wherein at least some of said cutting elements are positioned such that the prepad is at the junction of said pad and waterway.

5. A rotatable bit as set forth in claim 1, wherein said matrix of said tooth is free of engagement with the side faces of at least some of said cutting elements at the junction thereof with said pad.

6. A rotatable bit as set forth in claim 1, wherein said cutting element is triangular in shape and includes front, side, rear and base faces, and wherein said side faces form an apex which is fully exposed and which constitutes a top surface of said cutting element.

7. A rotatable bit as set forth in claim 6, wherein each said apex is oriented radially with respect to said tooth.

8. A rotatable bit as set forth in claim 6, wherein said apex is oriented tangentially with respect to said tooth.

9. A rotatable bit as set forth in claim 6, wherein said cutting element is spaced from the intersection of said waterway and said pad means.

10. A rotatable bit for use in earth boring comprising:

a carbide matrix body member having portions forming a gage and a face, said face including a plurality of waterways forming pad means between adjacent waterways, each said pad including a plurality of spaced synthetic polycrystalline diamond cutting elements mounted directly in the matrix during matrix formation, each of said cutting elements being of a predetermined geometric shape and being temperature stable to at least about 1200° C., the said cutting elements including a portion received within the body matrix of said pad and a front portion and side faces which extend above the surface of said pad, said front portion forming the cutting face of said cutting element, matrix material extending above said pad and forming a plurality of spaced teeth each of which includes a forward prepad portion, and a trailing support generally to the rear of the side faces and the front portion of said cutting element, the side faces of said cutting elements being exposed along the side of said associated tooth, said trailing support for each said tooth being greater in length than the width of said tooth and the length of said prepad, said prepad contacting and covering at least a portion of the cutting face of at least some of said cutting elements, and the portion of each of said elements which forms the cutting face extending more than 0.5 mm above the surface of the corresponding pad.

11. A rotatable bit for use in earth boring comprising:

a matrix body member having portions forming a gage and a face, a plurality of spaced synthetic polycrystalline diamond cutting elements mounted in the matrix of said face of said body matrix, said bit including a plurality of waterways, each of said cutting elements being of a predetermined geometric shape and being temperature stable to at least about 1200° C., each of said cutting elements having a front cutting face, side faces and a rear portion, all of which extend above said body matrix, and each of said cutting elements including a portion received within said body matrix, at least some of said cutting elements on said face being mounted in a tooth, a plurality of which are on said face and formed of matrix material to receive at least some of said cutting elements, at least some of said teeth including a trailing support contacting the entire rear portion of said cutting elements and prepad means which contacts the said cutting elements at least along a portion of the cutting face, said trailing support having a length at least equal to the length of said prepad, the side faces of at least some of said cutting elements being fully exposed and being free of matrix material of the associated tooth, and the front and side surfaces and said rear portion of said cutting elements extending more than 0.5 mm above the face of said matrix in which they are mounted.

12. A rotatable bit for use in earth boring comprising:

a matrix body member having portions forming a gage and a bit face, a plurality of spaced synthetic polycrystalline diamond cutting elements mounted directly in said matrix of said bit during matrix formation of said body member, each of said cutting elements being of a predetermined geometric shape and having a front face adapted to form the cutting front face and side and rear faces, and being temperature stable to at least about 1200° C., the said cutting elements being supported by a tooth, a plurality of which are provided on said bit face to support a plurality of cutting elements, said front, side and rear faces of said cutting elements extending above the matrix of the bit face in which they are mounted, each tooth including a body of matrix material which covers at least a portion of the front face and all of the rear face while all of the side faces are fully exposed, and at least the front face of said cutting element which is adapted to form said cutting face extending more than 0.5 mm above the matrix of the bit face in which they are mounted.

13. A rotatable bit as set forth in any of claims 1, wherein said cutting element is triangular in shape and includes a front face, adjacent side faces, a base face and a rear face, and at least a portion of said base face being received in said body matrix and said front face being adapted to form the cutting face of said cutting element.

* * * * *